US005529405A

United States Patent [19]

Breitenbach et al.

[11] Patent Number: 5,529,405

[45] Date of Patent: Jun. 25, 1996

[54] MANUAL CONTROL/OVERRIDE FOR AUTOMATIC FORMS THICKNESS ADJUSTMENT

[75] Inventors: John L. Breitenbach; Martin J. Brown, Jr.; Michael C. Campbell, all of Lexington, Ky.; Jeffrey H. Paterra, Vestal, N.Y.; Cathy J. Senft, Lexington, Ky.

[73] Assignee: International Business Machines Corporation, Armonk, N.Y.

[21] Appl. No.: 290,507

[22] Filed: Aug. 15, 1994

Related U.S. Application Data

[63] Continuation of Ser. No. 12,275, Feb. 1, 1993, abandoned.

[51] Int. Cl.[6] ..... B41J 11/20

[52] U.S. Cl. ..... 400/56; 400/708

[58] Field of Search ..... 400/315, 708, 400/56, 57, 55, 59

[56] References Cited

U.S. PATENT DOCUMENTS

| | | | |
|---|---|---|---|
| 4,138,719 | 2/1979 | Swanstrom et al. | 400/315 |
| 4,580,914 | 4/1986 | Rich et al. | 400/56 |
| 4,652,153 | 3/1987 | Kotsuzumi et al. | 400/56 |
| 4,676,675 | 6/1987 | Suzuki et al. | 400/56 |
| 4,812,059 | 3/1989 | Masaki | 400/56 |
| 4,881,835 | 11/1989 | Niikawa | 400/56 |
| 4,927,277 | 5/1990 | Niikawa | 400/56 |
| 4,974,974 | 12/1990 | Yoshida et al. | 400/56 |
| 4,990,004 | 2/1991 | Kawahara et al. | 400/56 |
| 5,009,526 | 4/1991 | Kirchhof | 400/56 |
| 5,037,217 | 8/1991 | Suzuki et al. | 400/124 |
| 5,061,095 | 10/1991 | Asai et al. | 400/56 |
| 5,074,685 | 12/1991 | Shimizu et al. | 400/56 |
| 5,074,686 | 12/1991 | Fare | 400/59 |
| 5,078,517 | 1/1992 | Hiroshi et al. | 400/59 |
| 5,088,848 | 2/1992 | De Falco | 400/56 |
| 5,137,377 | 8/1992 | Ito et al. | 400/56 |
| 5,156,464 | 10/1992 | Sakai | 400/56 |
| 5,156,466 | 10/1992 | Inagaki et al. | 400/56 |
| 5,204,537 | 4/1993 | Bennet et al. | 400/56 |
| 5,257,867 | 11/1993 | Ito et al. | 400/56 |
| 5,316,395 | 5/1994 | Imai | 400/56 |

*Primary Examiner*—Eugene H. Eickholt
*Attorney, Agent, or Firm*—Whitham, Curtis, Whitham & McGinn; Michael E. Belk

[57] ABSTRACT

User adjustment of an automatically established gap between a print head and a platen allows adjustment of print head gap relative to a set point by a simple key actuation operation which is preferably conducted during printing operation so that the user can directly observe the result of the adjustment. Storage of user defined adjustment values in non-volatile memory are correlated with measured thicknesses or tolerance ranges thereof and can be recalled after power off/power on cycles and/or after change of paper stocks in the printer. Adjustment limits are imposed to prevent printer damage and user adjustment can be carried out at higher resolution than automatic head gap setting. Graphical and fixed legend displays are preferably provided for confirmation of the adjustment and informing the operator of limits and operating limits and conditions of the gap adjustment.

18 Claims, 6 Drawing Sheets

MANUAL CONTROL/OVERRIDE FOR AUTOMATIC FORMS THICKNESS ADJUSTMENT

This application is a continuation of now abandoned U.S. Ser. No. 08/012,275, filed Feb. 1, 1993.

BACKGROUND OF THE INVENTION

1. Field of the Invention

The present invention generally relates to impact printers and, more particularly, to operator control of print head to platen or stock spacing, particularly in connection with arrangements for automatic compensation for stock thickness.

2. Description of the Prior Art

The increase of use of data processing systems and personal computers, particularly by businesses, has been accompanied by increased demand for printers capable of providing a high quality type font at high speed. Numerous technologies have been investigated for simultaneously answering these two requirements. However, current business practices often involve the need to print multiple copies at the same time on layered stock and not all printer technologies are suited to such requirements.

Such multiple copies, which are often color-coded for regulating distribution and communication of respective ones of the copies, are often preferred because of the assurance they provide of exact duplication of the information printed and for the convenience of uniformity of the number of copies and the ability to establish procedures for handling of each copy. These attributes are relatively difficult to duplicate with printers using, for instance, laser and ink-jet technologies since these technologies do not provide a mechanism for producing an image on other than the surface layer of multi-layer stock. Data processing techniques for generating multiple, serial copies has generally been limited to automatic generation of labels, often printed in the margins of documents. Even then, the very flexibility of data processing systems does not assure that the same number of copies with the same use, distribution or disposition designations will be uniformly produced. The production of color-coded copies, which may be easily accomplished with layered stock, requires the maintenance of inventories of multiple paper stocks and, often, the manual feeding of these different stocks to the printer unless complex and costly sheet feeders are employed.

Printer technologies which are capable of forming images on each layer of multi-layer stock generally rely on impact forces which may be transmitted through all sheets of the stock. Some such printers use technologies which are outgrowths from the typewriter arts such as so-called type ball and daisy wheel printers. Such technologies develop full "letter quality" but are limited in the number of characters and fonts which can be produced without manually changing the type ball or daisy wheel. So-called band printers are similarly limited. To produce a greater number of characters, symbols and fonts in a variety of symbol point sizes and pitches, so-called pin printers have gained widespread popularity and have developed resolution capabilities (e.g. dots per inch) which allow print quality to approach that of laser and ink-jet printers at the level of human visual perception. For purposes of this disclosure, these technologies (e.g. type ball, daisy wheel, band and pin printers) will be generically referred to hereinafter as "impact" printers.

Impact printers are well-known and are in widespread use at the present time. Being principally reliant on mechanical action of a relatively limited number of parts in the print head and transport therefor, they are generally less expensive than printers using other technologies. Further, while the actual printing action is far slower than in comparable laser or ink-jet printers, the mechanical constraint to lower image dot pitches reduces the amount of time required for "spooling" or the mapping of symbol codes to a dot image or character map from which the printer is driven. Therefore, overall printing time is comparable and may be less than that of laser and ink-jet printers, particularly on printed forms where relatively few characters or symbols are to be formed. (In contrast, ink-jet and laser printers typically form a dot image of the entire page or form prior to printing.) Accordingly, impact printers remain preferred for many applications, even where printing on multi-layer stock is not required.

Due to the mechanical action of impact printers, the print head to platen spacing is relatively critical to the print quality produced, especially in regard to the stock on which printing is done. The spacing between the print head and the platen or the surface of the paper stock relative to the distance over which the pins or type are accelerated greatly affects the impact forces which are applied to the stock. The optimum velocity is also subject to numerous other printing variables and parameters. For example, most impact printers include a ribbon for applying ink to the stock or the uppermost layer thereof and the forces applied thereto affects the efficiency with which ink transfer to the stock takes place. The mechanical motion of the ribbon, the amount of ink carried thereby and the texture of the paper are only a few of many other conditions which affect print quality and require relatively close regulation of pin or type velocity to obtain results which are considered satisfactory at the present state of the art. Therefore, it is common practice at the present time to at least provide manual adjustment of the print head to platen distance in order to allow for near-optimization of the print quality for different stocks.

An arrangement for automatic print head spacing adjustment to accommodate a plurality of paper stock and form thicknesses (hereinafter sometimes referred to collectively as "sheet material") with which the present invention is preferably implemented is disclosed in U.S. patent application Ser. No. 08/011,460 by Campbell et al., filed Jan. 29, 1993, which is assigned to the assignee of the present invention and hereby fully incorporated by reference. A summary of a prior arrangement (which is specifically not admitted to be prior art as to the present invention) is also described therein with which the present invention may be used. While this arrangement produces high quality print over a wide range of sheet material thickness and even a variety of textures where texture can be identified with particular thickness, the number of variables in an impact printing process almost necessarily requires some degree of operator intervention in order to obtain optimum results. Consider, for example, that a relatively new ribbon used in an impact printer will have a relatively high efficiency of transfer of ink to sheet material regardless of sheet material texture. A rough textured paper or a form of many layers may be directly smudged by a relatively new ribbon even at locations where printing is not done unless the head gap is increased from a gap which would otherwise be optimum. As the printer is used and the amount of ink in the ribbon is reduced, ink transfer efficiency is also reduced. However, ink transfer efficiency will not be reduced at the same rate with continued printing for both rough and smooth textured surfaces. Near the end of the useful lifetime of a printer ribbon, satisfactory printing may be possible on a rough textured stock but not on a smooth textured stock or vice-versa. Finally, the operator may wish to significantly increase impact forces to extract all possible ink (and printed pages) from a ribbon before it is discarded, even at the expense of poor print copy. Therefore, even when automatic head gap setting is provided and which provides superior results during the great majority of operating conditions and printing condition variables, the results may usually be further improved if the operator or user is allowed to supplement the action of the automatic system.

However, providing for such operator intervention in a manner which will accomplish improvement of results is complicated by many practical matters. For example, the range of such an adjustment is on the order of 0.010 inches or ±0.005 inches in 0.0005 inch increments from the position which would be set by an automatic head adjustment. A separate manual adjustment system which would perform in this manner and also provide repeatability would necessarily be complex and expensive. Further, any such separate system would interfere with the function and accuracy of any automatic system provided in the printer. Likewise, adjusting the print head gap by an electrical control arrangement would interfere with the operation of an automatic head gap adjustment arrangement as well as being largely duplicative thereof. Attempting to combine a user-controllable arrangement with an automatic arrangement raises the issue of separating the automatic and user-controllable functions (e.g. the user-defined values may cause loss of the automatic set point values supplied by the printer manufacturer).

Further, when the printer is being used to print on alternate sheet materials or paper stocks such as bond paper and multi-layer forms, different adjustments may be necessary or desirable for each. For example, bond paper may require an increase of head gap from a set point determined from an automatic system due to ribbon condition while a multi-layer form may require a decrease from an automatically determined set point in order to form satisfactory images on all sheets thereof. If these sheet materials are alternated, an adjustment will be required each time the sheet material is changed. Accordingly, it is desirable to be able to recall user defined set points in the same manner as manufacturer supplied automatic set points.

As a practical matter, whether the adjustment is made mechanically or electrically, most known head gap adjustment arrangements require opening the printer cabinet if not an off-line self-test or set-up routine. Accordingly, the result of an adjustment can only be observed by the printing of an entire page, which is wasteful and time consuming. Currently available printers do not allow adjustment while printing is being done on-line. Therefore, there is a time lag between the time the adjustment is made and the time the effect of those adjustments can be seen by the user. Therefore, there is no "feedback" to the user as the adjustment is made, reducing accuracy of the adjustment made and increasing the number of times adjustment must be made to arrive at a result which the user considers to be satisfactory.

SUMMARY OF THE INVENTION

It is therefore an object of the present invention to provide a mechanism which allows adjustment of printer head gap dimension by a user or operator during on-line operation of a printer.

It is another object of the invention to provide a head gap adjustment system which allows the operation of an automatic head gap or forms thickness adjustment to be supplemented by an operator or user.

It is a further object of the invention to provide a user controllable head gap adjustment system which preserves both head gap set points supplied by the manufacturer and user-specified adjustments in accordance with the thickness of sheet material placed in the printer.

It is yet another object of the invention to provide a printer in which an automatic adjustment of head gap to compensate for paper stock or form thickness can be supplemented or overridden by a simple operation by the user on a control panel of the printer.

In order to accomplish these and other objects of the invention, a method of operating a printer having means for automatically setting a head gap between a print head and a platen is provided including the steps of specifying a change of head gap from a first print head position to a second print head position and altering the head gap in accordance with the specifying step.

In accordance with another aspect of the invention, a printer including an arrangement for measuring thickness of sheet material between a print head and a platen and for automatically establishing a print head gap in accordance with said thickness including an arrangement for incrementing and decrementing an adjustment value, and an arrangement for altering said print head gap in accordance with said adjustment value.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
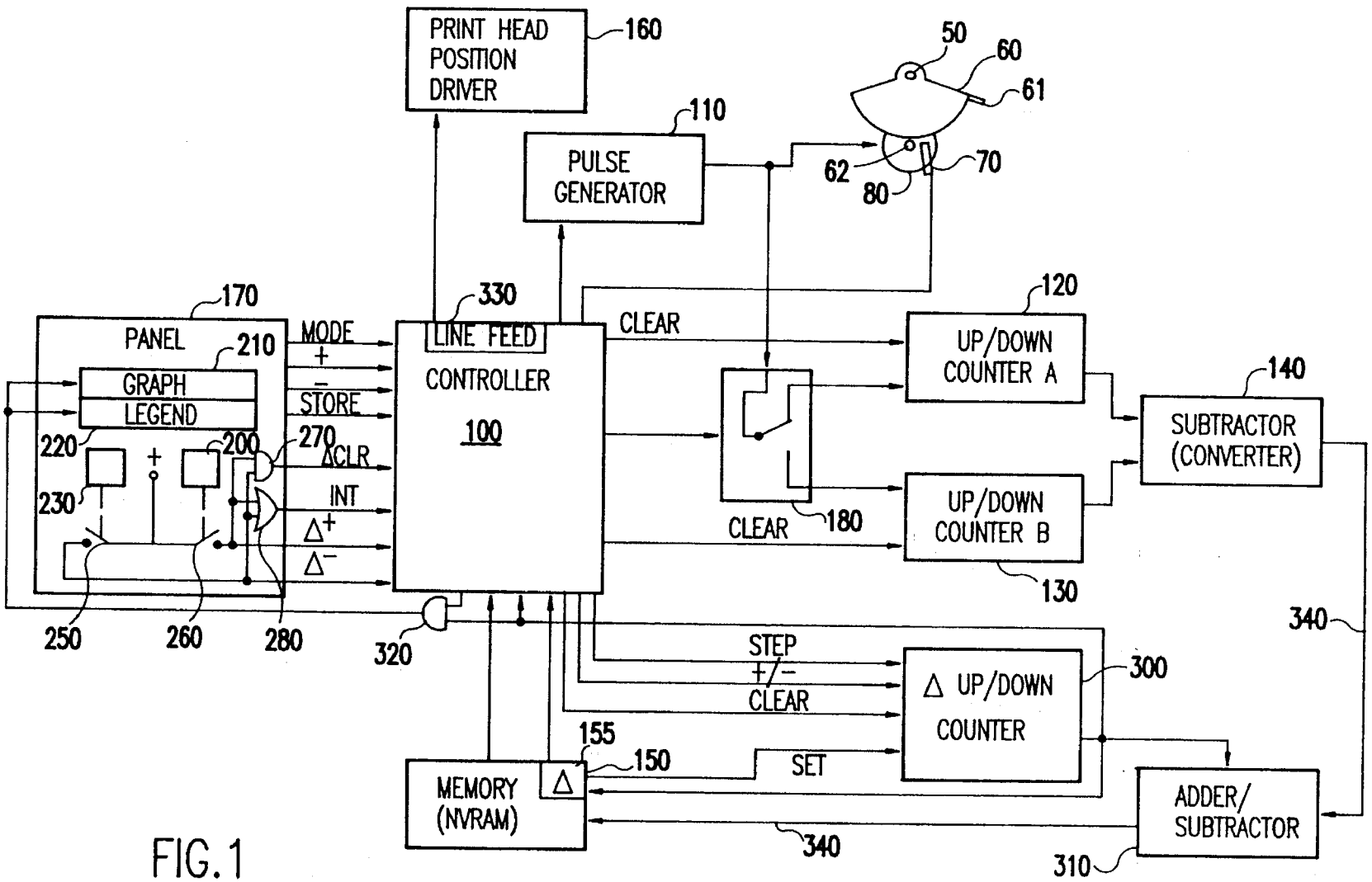
FIG. 1 is a schematic block diagram of a head gap adjustment system in accordance with the invention.

Referring now to the drawings, and more particularly to FIG. 1, there is shown, in schematic form, the overall organization of a system in accordance with the present invention. It is also to be noted that FIG. 1 has many elements in common with FIG. 2 of the above-incorporated U.S. patent application and a comparison therewith will be sufficient to the application of the present invention to other systems including automatic form thickness compensating head gap adjustments. Specifically, stepper motor 80 drives sector gear 60 through pinion gear 62 to turn eccentric shaft 50 to obtain movement of the print head (not shown) in a direction to alter the gap between the print head and the platen. A home position for the print head is established by sensor 70 which detects projection 61 when sector gear 60 is moved to a particular location. A controller 100, preferably in the form of a programmed microprocessor which can also provide many of the other functional elements of FIG. 1 as well as controlling other printer functions, directly controls pulse generator 110 and print head position driver 160. The print head position driver 160 provides for movement of the print head across the platen 21 (e.g. along a printing line). Pulse generator 110 provides drive pulses to a reversible stepping motor 80 for causing adjustment of the head gap as described above. It is also preferred that pulse generator 110 be capable of limiting the current (such as by insertion of a series resistance) supplied to the stepping motor 80, as will be discussed below. These pulses are also counted by up/down counters 120 and 130, respectively, in dependence on the particular step of the head gap adjustment process which is currently being executed by controller 100, as depicted schematically by switch 180. Controller 100 is also made responsive to a control panel 170, which, for purposes of the system and method of the invention disclosed in the above-incorporated application, need be no more than one or more switches for controlling operational mode of the printer. Feedback is also provided for establishing predetermined head gap dimensions for differing thicknesses of paper stock through subtractor 140 which computes a difference in the values accumulated in up/down counters 120 and 130. This computed difference value is then preferably used as an address to access numbers in memory 150 which govern the length of a pulse train necessary to develop a predetermined head gap for each thickness of paper stock. This operation is described in detail in the above-incorporated application.

Additionally, the present invention preferably includes two further switches 250, 260, preferably actuated by buttons 230, 240, and a display 210, 220 on the control panel 170 although the function of the switches can be equivalently provided by other switches either in combination or by alteration of functions by particular modes of operation and the display is not necessary to the practice of the invention. Basically, two output signals are preferably supplied from the panel 170 to the controller 100 for incrementing (Δ+) or decrementing (Δ−) the number of steps or distance value by which the head gap is defined and established in relation to a reference or home position. It is also preferred to provide a "clear" signal which can be conveniently provided by detecting coincident actuation of both of switches 250, 260 with simple logic such as an AND gate 270. Alternatively, an additional switch could be provided. As will be described below, it is also convenient to provide for a detection of actuation of either switch 250, 260, as will be discussed in greater detail below, and which is schematically illustrated by OR gate 280 for generating an interrupt signal. However, it is to be understood that the connections and logic gates illustrated in FIG. 1 are schematically illustrative of functions performed by the overall invention and could be done in many ways. For example, it is considered preferable for reasons of signal timing, hardware implementation and cost to generate an interrupt (e.g. the function illustrated by OR gate 280) based on detection of a change of a head position or adjustment increment value rather than by generating such a signal directly at the panel.

It will also be appreciated that details of the display, if provided, are not critical to the practice of the invention and many different display arrangements will be evident to those skilled in the art. For example, graph display 210 need be no more than an array of light emitting diode indicators or panel indicator lights, possibly including a binary to 1 of n code decoder. Likewise, legend display 220 need be no more than a similar array of lights beside ones of a plurality of fixed legends. However, since many display technologies are currently available and since a display is desirable to inform the operator of other operating conditions and functions of the printer which are otherwise unrelated to the present invention, it is preferred to provide both display sections 210 and 220 as a matrix liquid crystal display with legends provided as fixed Stored messages.

The output of counter 300 is also supplied to controller 100 so that in the preferred form of the invention, the display mode can be changed during the adjustment operation and at other times be made to revert to another display mode. This is schematically depicted by AND gate 320 which would be capable of gating data to the display. A separate control connection could be made from the controller 100 to either or both of the display sections 210, 220.

To support the function of the invention, it is only necessary to provide the functions of an additional register 300, an adder/subtractor 310 and a small region of non-volatile random access memory (NVRAM) 155, preferably as a part of memory 150 (which may be implemented as either read-only memory (ROM) or NVRAM). It is considered important to the practice of the invention that a separate register and NVRAM be functionally provided to hold the user defined adjustment increment or decrement A (hereinafter referred to simply as "user defined adjustments") independently of the structure which contains the set points supplied by the manufacturer for head gaps corresponding to and accessible in accordance with different measured thicknesses of sheet material. The user defined adjustments are also stored in a manner corresponding to and accessible in accordance with measured thicknesses. This is preferably done so that the set points defined by the manufacturer are always available and the user defined adjustments may be concurrently recalled and used automatically or modified or cleared to return to the original, unadjusted, set points.

To assure storage of the user defined adjustments, the contents of A up/down counter 300 is supplied to NVRAM 155 and an output of the NVRAM 155 is also provided for an input to the counter 300 as a set value when a change of sheet material thickness is detected and the head gap is automatically set. This effectively recalls a previous user defined adjustment when a measured sheet material thickness is recognized for which an adjustment has previously been made. The contents of counter 300 is also supplied to adder/subtractor 310 and added to or subtracted from the head gap or measured thickness value any time a measurement or an adjustment is made while the unaltered value of measured thickness remains stored. Thus a value for head gap can be obtained at any time and can be performed at any desired time during the printing process. Accordingly, it is considered preferable for providing optimum visibility of the effect of the adjustment to the operator and for simplicity of management and availability of the processor of controller 100 of the printer, to limit the times at which the adjustment is actually carried out to the time when the print head is positioned to begin a new pass across the platen (e.g. at the beginning of a new print line). Of course, any other particular printer condition could also be used. The time of the beginning of a printing line, however, is readily detected from, for example, a line feed command within the printer controller, as illustrated at 330 of FIG. 1. As an aside, at the present state of the art of pin printers, the duration of a pass of the print head across the platen is a relatively small fraction of a second and approximates the reaction time of an operator. Therefore, no useful purpose is served by conducting an interrupt during a line of printing (and which could also cause the change to be made at the interior of a character).

Figure 2:
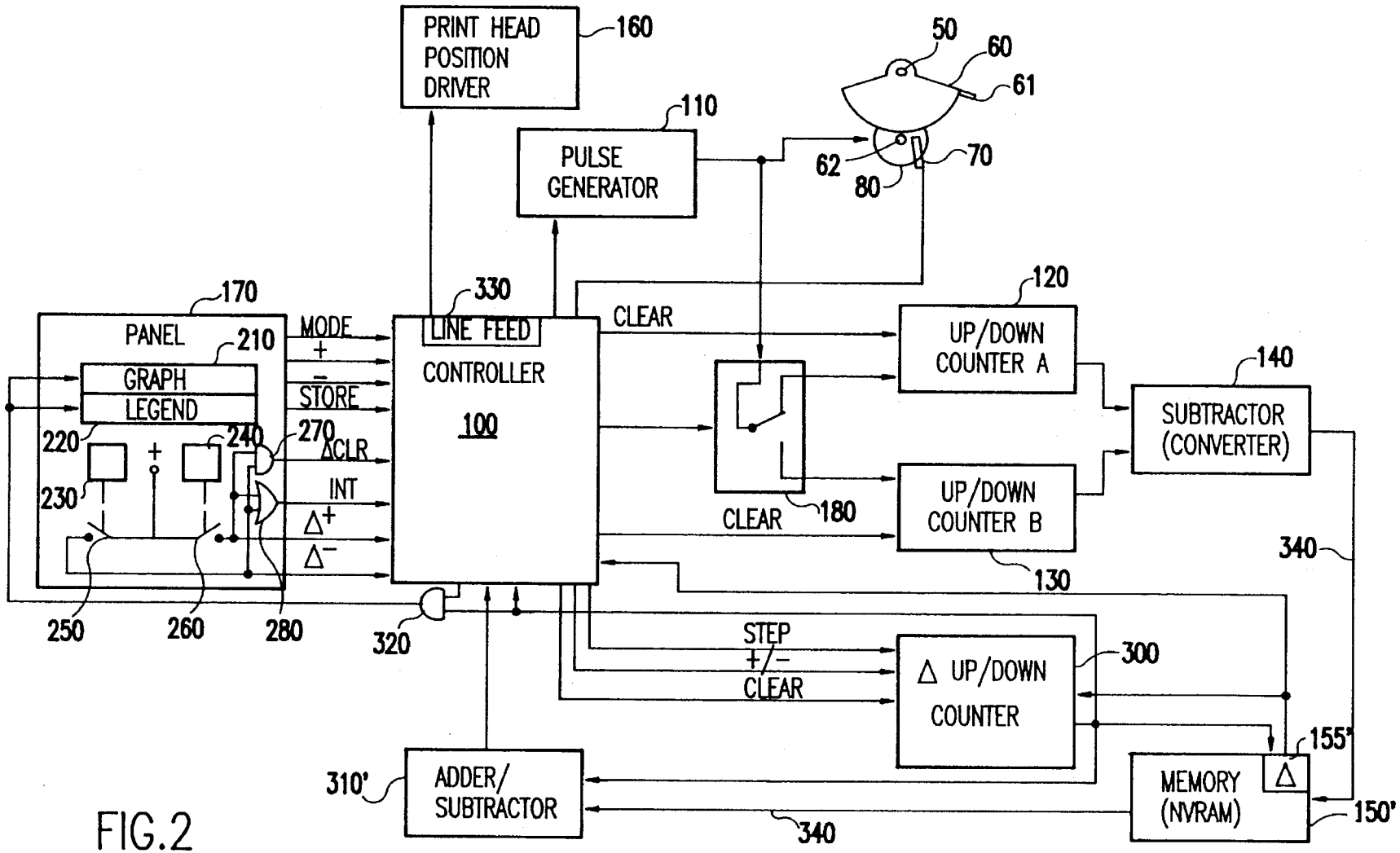
FIG. 2 is a similar schematic illustration of a variation of the invention allowing reduction of memory size.

It should also be understood that some variation in the architecture of the invention as shown in FIG. 1 may be advantageous, as shown in FIG. 2. For example, as will be discussed in greater detail below, it is considered to be preferable, if the size of memory 150 is given increased weight in design, that head gap should be correlated to a tolerance range of measured thicknesses. (A 1:1 correspondence between measured thicknesses and gap set points would, of course, correspond to a tolerance of zero.) This would allow a memory 150 of reduced size to be employed and resolution throughout the automatic portion of the system as disclosed in the above-incorporated application to be reduced. For example, head gaps could be specified at a thickness resolution of 0.002 inches and user defined adjustments specified and carried out to a resolution of 0.0005 inches. Then the adjustment value could be directly added to or subtracted from the value which defines and establishes final head gap.

This can be done while maintaining high resolution of the manual adjustment simply by reversing the order of memory 150' and adder/subtractor 310' in the feedback loop 340. The savings in memory are evident since the number of head gap set points are reduced and, even at which user defined adjustment resolution, only one such user defined adjustment is defined for each range of measured thicknesses. This variation of the invention does not usually have an adverse effect on printer performance for any given user since it is unlikely that a user will wish to be printing on such a variety of paper stocks that more than one will fall within any given thickness range, particularly if the ranges are limited to 0.002 inches or less.

If this variation of the invention is adopted and particularly if implemented in software, it has been found preferable to maintain measurement resolution somewhat higher than the resolution of each range and to specify the tolerance as a specific distance range rather than as a percentage of measured thickness. If these conditions are implemented, it has been found that errors due to cumulative measurement differences when measuring paper stock or forms of the same nominal thickness will be avoided.

It is also to be understood, as an incident of printer design at the present time, that it is preferred to store only the most recent user defined adjustment for a single head gap corresponding to a single measured thickness of sheet material. This modification of the basic form of the invention further reduces memory requirements and avoids the need to provide an address to NVRAM section 155 or 155'. This modification does not allow automatic provision of user defined adjustments when forms or paper stocks are changed but, nevertheless, avoids the need for adjustments to be made for each power off/power on cycle when forms or paper stocks are not changed. The additional adjustment when the user changes paper stocks is generally expected by users of other currently available printers and is facilitated in the present invention by front panel control and the immediate visual feedback to the user during on-line printing operation.

Before discussing the operation of the invention in detail, an overview thereof will demonstrate the convenience and efficacy thereof to achieve the above-stated objects. When the printer is to be used, a paper stock is or has been inserted which initiates a measurement of the thickness thereof and a corresponding calculation and setting of a corresponding head gap, as discussed in detail in the above-incorporated application. Assuming that no adjustment of the automatically established head gap has been done and the operator begins a print operation, the printer will begin printing lines of a page. (As is understood in the art, the term "lines" in this context, refers to a pass of the print head across the platen and sheet material or paper stock. Such a pass of the print head over the sheet material or paper stock will usually, but not necessarily, coincide with a line of text.) If the operator observes the operation of the printer at this time and determines that the result is too light (or to dark), key 230 or key 240 is pressed to actuate one of switches 250 or 260, respectively. Once either of keys 230 or 240 is pressed, either the key actuation is directly detected (e.g. by OR gate 280) or, preferably, the counter 300 is incremented or decremented under control of controller 100 and this change detected by controller 100. The display mode is changed to indicate the increment or decrement and the head gap is recomputed. As indicated above, an interrupt signal to the printer is also generated and, when an appropriate point, such as the beginning Or end of a print line, is reached, the adjustment of the head gap is carried out by the stepping of motor 80.

Figure 6:
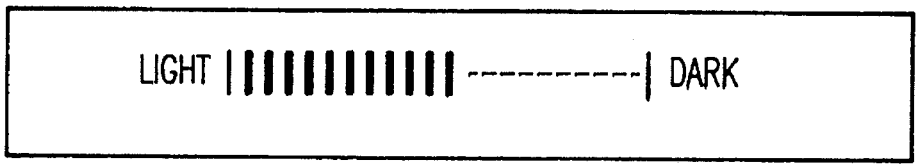
FIGS. 6, 7, 8 and 9 are representative displays in accordance with a preferred form of the invention.
Figure 7:
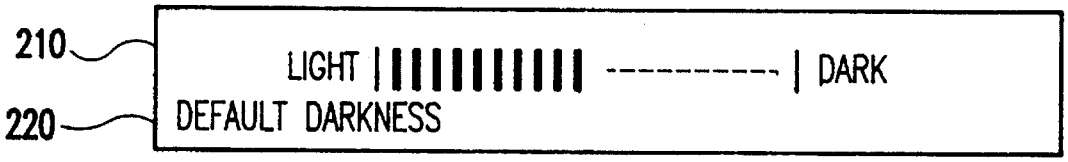
Figure 8:
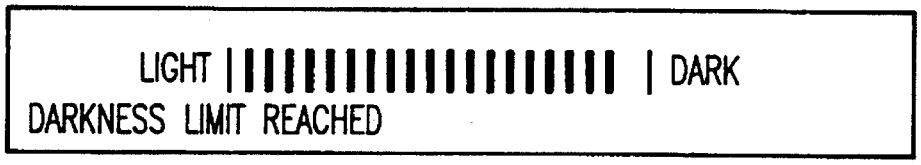
Figure 9:
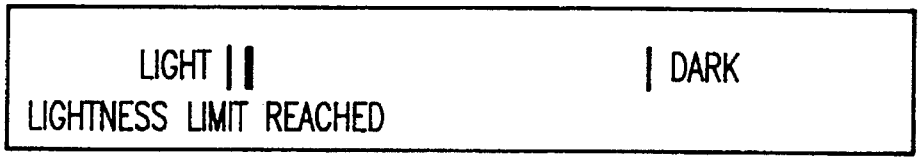

If a paper stock has not been inserted and measurements thereof automatically made or if the printer is not on-line or printing, a message indicating that the function is not available other than under those conditions is displayed. It is also preferred that the capacity of counter 300 be limited in order to limit the range of adjustment which can be carried out by the operator so that the operator cannot specify an adjustment which would cause damage to the print head by driving it against the platen. Therefore, the resolution of the bar graph display need be no more than the number of steps of user defined adjustment provided, as shown in FIG. 6. If the user attempts to specify an adjustment beyond this range, counter 300 is not further incremented and a lightness or darkness limit indication is displayed, as shown in FIGS. 8 or 9.

For example, in a preferred implementation of the invention, for forms or paper stock of measured thickness of less than 0.010 inches, the user specified adjustment is limited to nine steps of 0.0005 inches per step on either side of the head gap set point established by the automatic head gap setting system or a range of ±0.0045 inches in order to prevent the head being driven against the platen by the operator. Since the automatic gap set point is above the surface of the sheet material, the user cannot inadvertently drive the print head against the platen but can bring the print head very close to the surface of the paper stock. A second range is also preferably provided for measured thicknesses greater than or equal to 0.010 inches in which the increment size and range are doubled. In this case also, the print head cannot be driven against the platen by the user. (On some multi-layer forms, the print head could be brought against the surface of the front sheet. However, this is not necessarily undesirable since such adjustment may be desired in order to form an image of desired quality on underlying sheets of the multi-layer form.) In any event, it is preferred that the bar graph display 210 indicates an adjustment relative to the automatic head gap set point (e.g. corresponding to the middle of the bar) and warns the operator when no further adjustment can be made.

In a similar fashion, it is also preferred to provide a facility to allow the user to quickly return to the automatic head gap set point. This may advantageously be done by providing for the generation of a "clear" signal for resetting counter 300 to zero. This can readily be done, for example, by AND gate 270 in response to simultaneous actuation of both keys 230 and 240 or in other ways which will be evident to those skilled in the art. In this case, the resetting of counter 300 is confirmed by display of a "default darkness" message on legend display 220.

Figure 3:
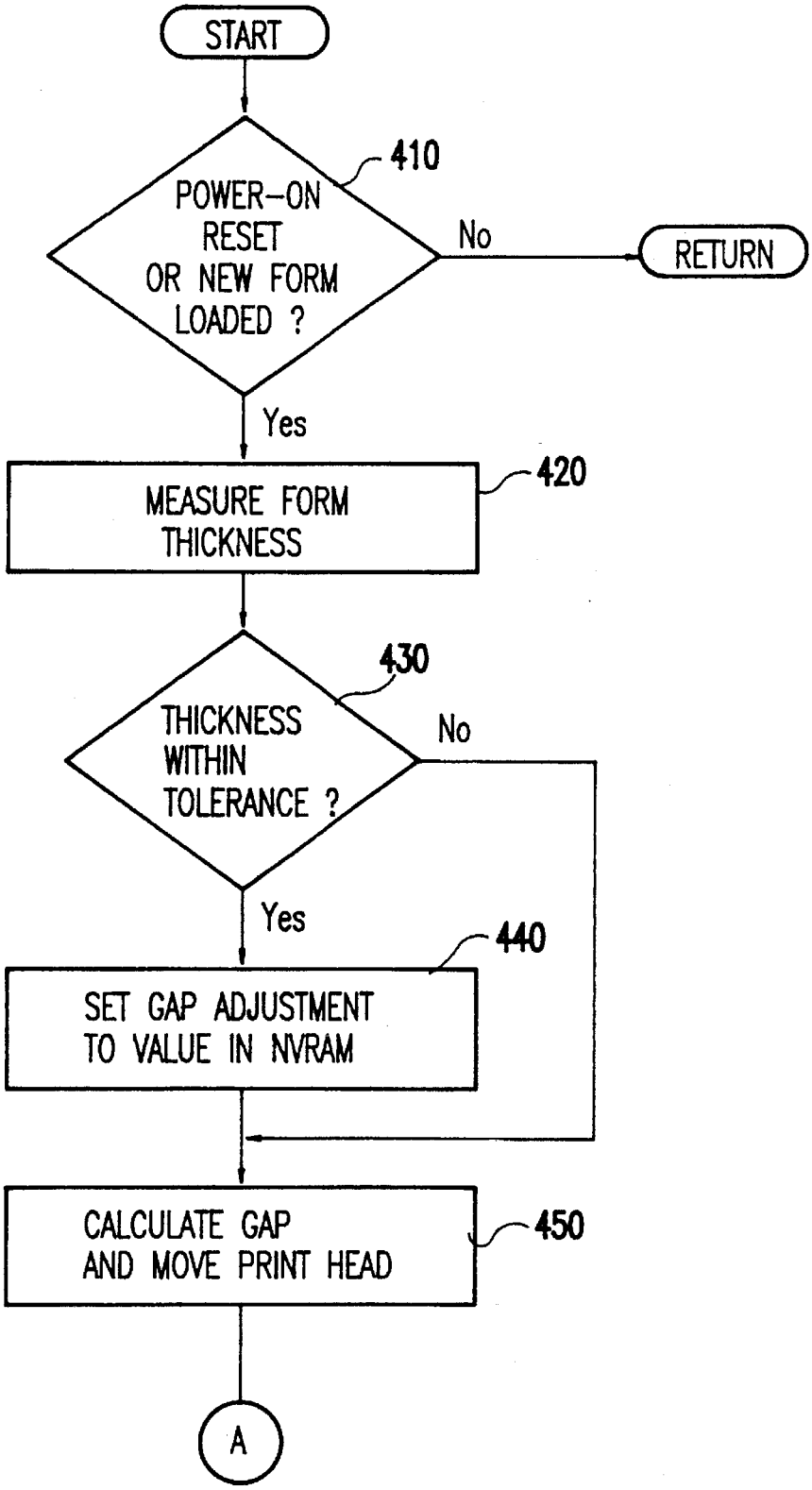
FIGS. 3, 4 and 5 are flow charts illustrating the operation of the invention.
Figure 4:
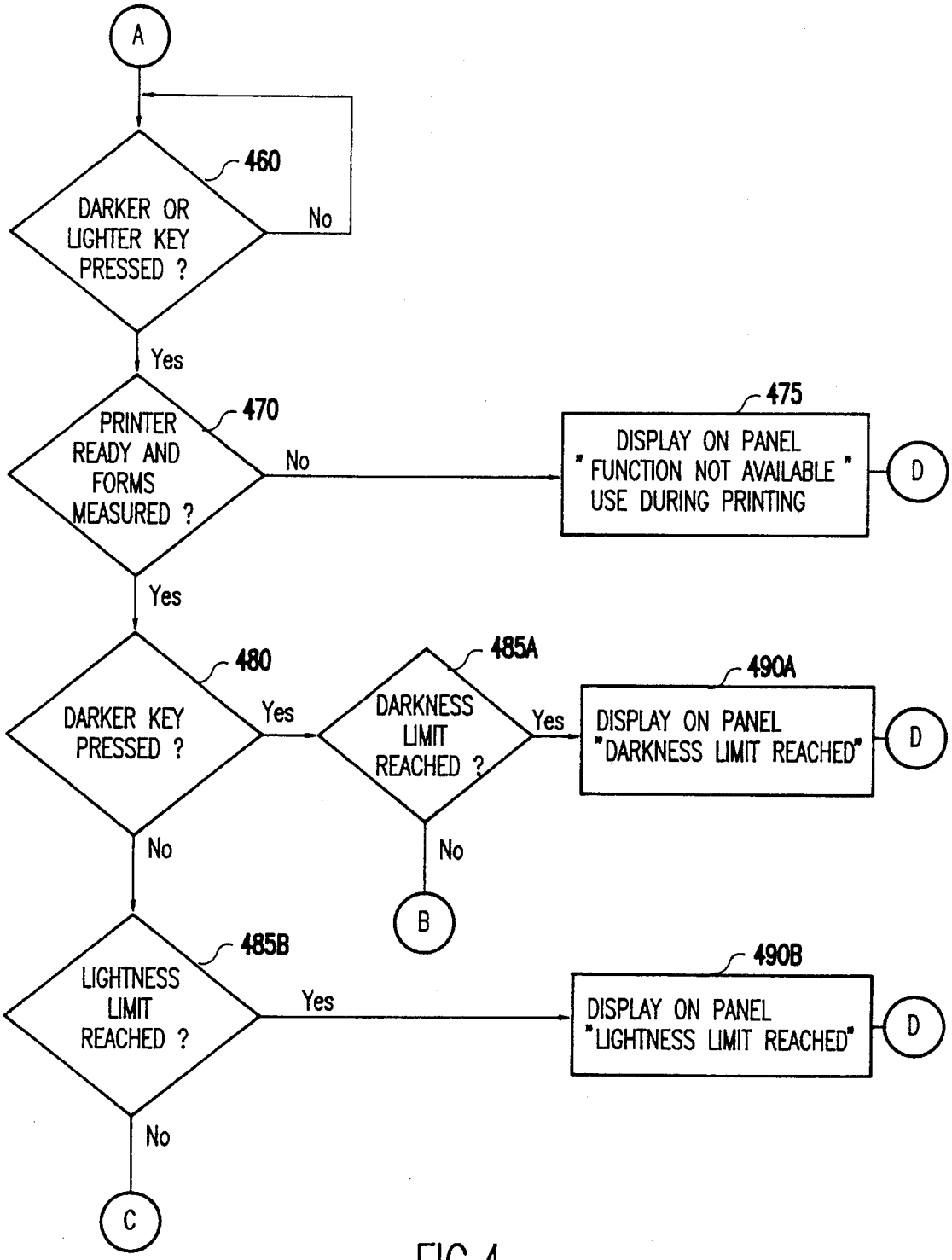
Figure 5:
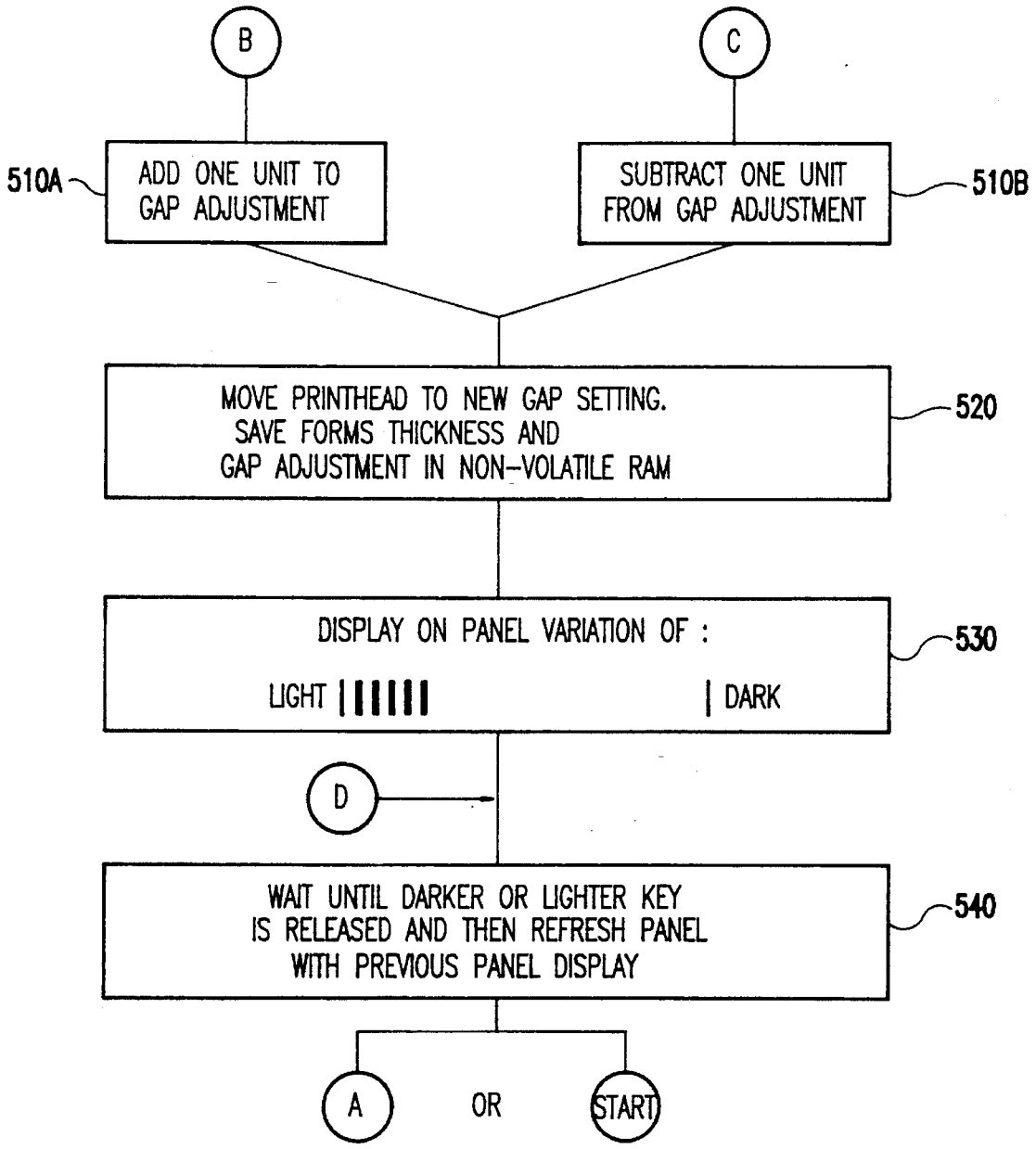

Referring now to FIGS. 3–5, the operation of the invention will be described in greater detail. FIG. 3 shows a series of operations for initiating operation of the present invention and includes the optional procedure for associating a single particular head gap with a range of measured thickness values. An initial step 410 of testing for a power-on reset operation or the loading of a new form or paper stock allows the process of the present invention to be inserted at virtually any location in the control process for the printer executed by controller 100. Upon the occurrence of either of these conditions, the printer control process (which will be in a reset or wait state in accordance with those conditions) will be interrupted or branch to perform a thickness measurement 420 and forms thickness adjustment preferably in accordance with the methodology disclosed in the above-incorporated application, if necessary. If not, the reset process or wait state is not disturbed. Then, optionally, if the measured thickness is not within a specified tolerance corresponding to a range which included a previously stored measured thickness as determined at 430, any previously stored user defined adjustment will not be appropriate and the process branches to step 450 where the head gap is calculated and the print head is moved to achieve the head gap set point specified. If the measured thickness is within the same range as a previously stored thickness, the previously stored adjustment is retrieved at step 440 and set into counter 300. This stored adjustment is then used in step 450 in the calculation of the head gap.

The process then continues as illustrated in FIG. 4. If actuation of either the "lighter" or "darker" key (220, 230) is detected at 460, the operation of the invention will be invoked by branching of the control process to step 470 in which it is determined whether or not the printer is in an operational state appropriate to adjustment (e.g. a printing or ready state and paper stock loaded and measured). If not, the user is informed at step 475 that the head adjustment function is not available in that printer state and, preferably, the state appropriate to its use. If adjustment is appropriate, the "darker" or "lighter" key is identified at step 480 and the contents of counter 300 are tested to determine if an adjustment limit has been reached at 485A or 485B, as appropriate. If either limit has been reached, a corresponding legend is displayed at one of steps 490A and 490B. In any of these conditions causing a legend display, no adjustment is possible and the process branches to D of FIG. 5. Otherwise the process branches to point B or point C in dependence on whether the "darker" or "lighter" key is actuated.

In either of these latter cases, as shown in FIG. 5, one step is added to (510A) or subtracted from (510B) the count in counter 300, the gap is recalculated and the head is moved, preferably at a particular time in the print cycle, such as the beginning or end of a print line, as discussed above. The new count in counter 300 is then saved in NVRAM section 155 to complete step 520. The bar graph display is then updated at step 530 to indicate the present relative head gap adjustment and confirm that the adjustment has been carried out. Then, if actuation of one of keys 220, 230 continues, the process is repeated by looping back to the process illustrated FIG. 4. However, when neither key is actuated, the display is restored to the previous display mode and the process is exited until re-entered in the manner illustrated in FIG. 3, when a new form or power off/power on cycle is detected, or in the manner illustrated in FIG. 4 when one of keys 220, 230 is again actuated.

Accordingly, it is seen that the apparatus and method of the present invention provides a technique by which a user or operator of a printer may supplement or override the operation of an automatic form measurement and head gap setting system by a simple operation at a control panel of the printer. The adjustment can be done during the printing operation and the effect of the adjustment on print quality can be seen by the operator or user as the adjustment is carried out. Usually the adjustment can thus be completed during the printing of a single page and waste of time and further pages is avoided. The adjustment is stored and recalled in accordance with the measured thickness and such operator intervention is thus limited to the time forms or paper stock is changed or even to the change of other, less frequent, conditions such as a significant depletion of ink from the printer ribbon.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A method of operating a printer, said printer including means for automatically setting a head gap between a print head and a platen, said means for setting a head gap including means for establishing a head location set point, said method including the steps of specifying a change of head gap from a first print head position to a second print head position by an incremental distance from said head location set point, and altering said head gap set point in accordance with said specifying step with said means for automatically setting a head gap.

2. A method as recited in claim 1, wherein said step of altering said head gap is performed in response to detection of a particular printer condition during said printing operation.

3. A method as recited in claim 2, wherein said particular printer condition is the termination of a print line.

4. A method as recited in claim 2, wherein said particular printer condition is a line feed.

5. A method as recited in claim 1, including the further steps of detecting when said specifying step is performed, and incrementing or decrementing a value corresponding to said change of head gap position, and displaying an image representing said value.

6. A method as recited in claim 1, including the further steps of storing an adjustment value specified in said specifying step, measuring a thickness of sheet material between said print head and said platen, comparing a result of said measurement with a previously stored measurement of thickness of sheet material, and retrieving said adjustment value upon correspondence of said measurement and said previously stored measurement.

7. A method as recited in claim 1, including the further steps of storing an adjustment value specified in said specifying step, measuring a thickness of sheet material between said print head and said platen, comparing a result of said measurement with a previously stored measurement of thickness of sheet material, and retrieving said adjustment value upon correspondence of said measurement to a tolerance range which includes said previously stored measurement.

8. A method as recited in claim 5, further including the steps of comparing said value to upper and lower limit values, and displaying a predetermined image upon correspondence of said value with one of said upper and lower limit values.

9. A method as recited in claim 1, wherein said altering step is performed during a printing operation.

10. A printer including an arrangement for measuring thickness of sheet material between a print head and a platen and means for automatically establishing a print head gap set point in accordance with a measured thickness, said printer including a means for incrementing and decrementing said head gap set point by an adjustment value, and means for altering said print head gap in accordance with said adjustment value during a printing operation of said printer.

11. A printer as recited in claim 10, further including means for detecting a particular printer condition and wherein said means for altering said print head gap is responsive to said means for detecting said particular printer condition.

12. A printer as recited in claim 11, wherein said particular printer condition is a line feed operation to be executed.

13. A printer as recited in claim 11, wherein said particular printer condition is when said printer reaches an end of a print line.

14. A printer as recited in claim 10 wherein said print head gap is established in accordance with a set point stored in memory and accessed in accordance with said measured thickness and further including means for incrementing said set point by said adjustment value.

15. A printer as recited in claim 10 wherein said print head gap is established in accordance with a set point stored in memory and accessed in accordance with said measured thickness and further including means for incrementing said measured thickness by said adjustment value.

16. A printer as recited in claim 10, further including comparison means for comparing said measured thickness with a previously stored measured thickness of sheet material, means for storing said adjustment value and means responsive to said comparison means for adjusting said head gap in accordance with said stored adjustment value when said head gap is established in accordance with said measured thickness.

17. A printer as recited in claim 10, further including comparison means for comparing said measured thickness of sheet material with a tolerance range corresponding to a previously stored measured thickness, means for storing said adjustment value and means responsive to said comparison means for adjusting said head gap in accordance with said stored adjustment value when said head gap is established in accordance with said measured thickness.

18. A printer as recited in claim 10, wherein said means for altering said print head gap in accordance with said adjustment value includes means for altering said print head gap during a printing operation of said printer.

* * * * *